US007630505B2

(12) United States Patent
Shimamura

(10) Patent No.: US 7,630,505 B2
(45) Date of Patent: Dec. 8, 2009

(54) LOUDSPEAKER SYSTEM

(75) Inventor: Naoki Shimamura, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 1021 days.

(21) Appl. No.: 11/016,320

(22) Filed: Dec. 17, 2004

(65) Prior Publication Data

US 2005/0147263 A1 Jul. 7, 2005

(30) Foreign Application Priority Data

Jan. 5, 2004 (JP) ..... 2004-000325

(51) Int. Cl.
*H04R 3/00* (2006.01)

(52) U.S. Cl. ..... 381/111; 381/116; 381/55; 381/123; 381/189; 381/120; 330/51; 330/298

(58) Field of Classification Search ..... 381/111, 381/123, 55, 120, 116–117, 189; 330/51, 330/298, 207 P
See application file for complete search history.

(56) References Cited

U.S. PATENT DOCUMENTS 3,925,709 A * 12/1975 Mitchell et al. ..... 361/100
6,163,613 A 12/2000 Cowans
6,647,120 B2 * 11/2003 Howze ..... 381/55
2002/0085726 A1 * 7/2002 Fuqua ..... 381/111
2002/0146135 A1 * 10/2002 Howze ..... 381/55

FOREIGN PATENT DOCUMENTS

JP 52-100225 8/1977
JP 08-033087 2/1996

* cited by examiner

*Primary Examiner*—Vivian Chin
*Assistant Examiner*—Disler Paul
(74) *Attorney, Agent, or Firm*—Brinks, Hofer, Gilson & Lione

(57) ABSTRACT

There is provided a low-cost loudspeaker system which can adjust attenuation and provide protection against an excessive input. Between input terminals and a loudspeaker unit is provided a serial circuit including a plurality of resistor elements. A switch is provided which can switch between connected and disconnected states of two points, which includes one or more resistor elements of the serial circuit therebetween, through an over-current protection element.

17 Claims, 1 Drawing Sheet

LOUDSPEAKER SYSTEM

BACKGROUND OF THE INVENTION

1. Field of the Invention

The present invention relates to a loudspeaker system, and more particularly relates to a loudspeaker system which adjusts the acoustic pressure level of a loudspeaker, and simultaneously provides protection against a large input.

2. Description of the Related Art

Some conventional loudspeaker systems include a protection circuit which prevents damage due to an excessive input to a loudspeaker (refer to Japanese Laid-Open Patent Publication (Kokai) No. H8-33087). Some loudspeaker systems including tweeters and the like are provided with attenuator circuits for adjusting the acoustic pressure level of respective loudspeakers. FIG. 3 shows an example of the configuration of a conventional loudspeaker system.

The conventional loudspeaker system shown in FIG. 3 is provided with input terminals 10, a loudspeaker unit 20, an attenuator circuit 30 used for adjusting the acoustic pressure level, and an excessive input protection circuit 40. The attenuator circuit 30 includes resistor elements 31, 32 connected serially with each other, and a switch 33 which selectively switches between connected and disconnected states of two points including the resistor elements 31, 32 therebetween such that the acoustic pressure level output from the loudspeaker unit 20 is adjusted to a desired level by short-circuiting terminals 33*a*, 33*b*, or 33*c* using a jumper wire JP. The excessive input protection circuit 40 includes an over-current protection element 41 and a resistor element 42, and the resistor element 42 (shunt resistor) is connected in parallel with the over-current protection element 41. The over-current protection element 41 is a resistor element having a positive temperature coefficient, for example; it generates heat if a current more than a predetermined magnitude is passed, which rapidly increases the resistance of the resistor element, and consequently interrupts a signal. The resistor element 42 serves to restrict a signal current if the over-current protection element 41 interrupts the signal current, and supply the loudspeaker unit 20 with the resulting restricted signal to prevent a complete interruption of a reproduced sound output from the loudspeaker unit 20.

As described above, since the attenuator circuit and the excessive input protection circuit are separately provided in the conventional loudspeaker system, there is a problem that the number of resistor elements in these circuits increases, resulting in an increased cost. Further, in the conventional loudspeaker system, even if the attenuator circuit 30 attenuates the input signal to a sufficiently low level, namely, the attenuator circuit 30 is set to sufficiently attenuate the maximum possible signal applied to the input terminals 10 (set to attenuate the signal to a level equal to or less than the maximum rated input of the loudspeaker unit 20), since the signal is always supplied to the loudspeaker unit 20 through the over-current protection element 41, the sound quality often degrades due to a characteristic of the over-current protection element 41.

SUMMARY OF THE INVENTION

In view of the foregoing, it is an object of the present invention to provide a low-cost loudspeaker system which can adjust the attenuation, and simultaneously provide excessive input protection.

To solve the above problem, the loudspeaker system according to the present invention includes a serial circuit that includes a plurality of resistor elements connected serially, a loudspeaker unit connected to the serial circuit, an over-current protection element, and a switching circuit that switches between connected and disconnected states of two points, which include one or more resistor elements of the serial circuit therebetween, through the over-current protection element.

In addition, the combined resistance of all of the resistor elements included in the serial circuit may be set such that the possible maximum input to the loudspeaker system does not cause the input to the loudspeaker unit to exceed the maximum input rating of the loudspeaker unit.

Additionally, to solve the above problem, a loudspeaker system according to the present invention includes a first resistor element, at least one resistor element different from the first resistor element, a loudspeaker unit connected to the first resistor element, an over-current protection element that interrupts an impressed signal current more than a predetermined signal current, and a switching circuit that switches among: a state connecting the over-current protection element in parallel with the first resistor element, a state connecting the over-current protection element and the at least one resister element in parallel with the first resistor element, and a disconnected state.

Further, the resistance of the first resistor element may be set such that the maximum possible input to the loudspeaker system does not cause the input to the loudspeaker unit to exceed the maximum input rating of the loudspeaker unit.

The over-current protection element may be a resistor element having a positive temperature coefficient.

According to the present invention, the resistor element used to set the attenuation can also serve as a shunt resistor used against an excessive input, and it is possible to reduce the cost of the loudspeaker system which can adjust the attenuation and simultaneously provide protection against an excessive input.

In addition, according to the present invention, since the combined resistance of the resistors used to set the attenuation is set to provide such an attenuation that the maximum possible input to the loudspeaker system does not cause an input to the loudspeaker unit to exceed the maximum rated input of the loudspeaker unit, if the attenuation is set to the maximum, it is possible to eliminate the degradation of the sound quality due to the characteristic of the over-current protection element.

DESCRIPTION OF THE PREFERRED EMBODIMENTS

A description will now be given of embodiments of a loudspeaker system according to the present invention with reference to the drawings.

First Embodiment

Figure 1:
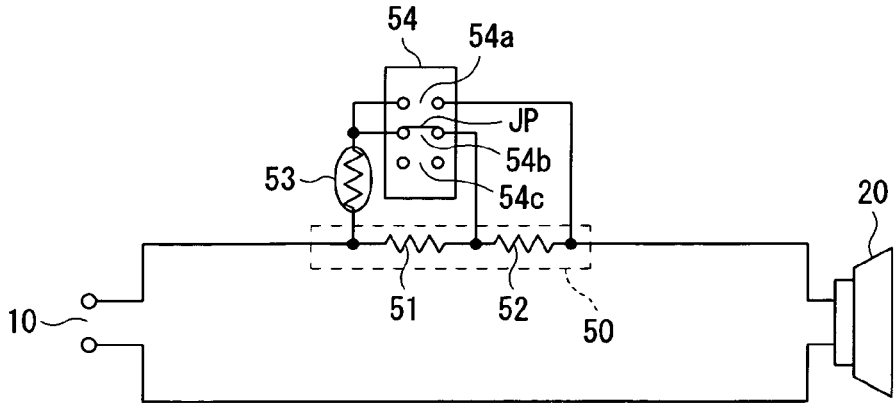
FIG. 1 shows the configuration of a loudspeaker system according to a first embodiment of the present invention.

FIG. 1 shows the configuration of the loudspeaker system according to a first embodiment of the present invention. As FIG. 1 shows, the loudspeaker system according to the first embodiment includes input terminals 10, a loudspeaker unit 20, a serial circuit 50, an over-current protection element 53, and a switch 54.

The serial circuit 50 includes resistor elements 51, 52, and is serially arranged between the input terminal 10 and the loudspeaker unit 20. The over-current protection element 53 is a resistor element having a positive temperature characteristic, for example; it generates heat if a current more than a predetermined magnitude is passed, which rapidly increases the resistance of the resistor element, and consequently interrupts a signal current. The switch 54 is arranged so as to switch between connected and disconnected states of two points, which include the resistor elements 51, 52 of the serial circuit 50 therebetween, through the over-current protection element 53, thereby adjusting the attenuation according to a preference of a user by short-circuiting terminals 54*a*, 54*b*, or 54*c* using a jumper wire JP.

According to the present embodiment, the resistances of the resistor elements 51, 52 of the serial circuit 50 are set such that the attenuation is 0 dB, −3 dB, or −6 dB respectively if the terminals 54*a*, the terminals 54*b*, or the terminals 54*c* of the switch 54 are short-circuited. It should be noted that the combined resistance of the resistor elements 51 and 52 is set such that the possible maximum input signal impressed on the input terminals 10 does not cause the input signal to the loudspeaker unit 20 to exceed the maximum rated input of the loudspeaker unit 20.

The user short-circuits the terminals 54*a*, 54*b*, or 54*c* using the jumper wire JP on the switch 54 to attain a desired attenuation before using the loudspeaker system, thereby adjusting the attenuation.

If the attenuation is to be set to 0 dB, the terminals 54*a* are short-circuited using the jumper wire JP. In this case, if the signal impressed on the input terminals 10 is at a normal level, the signal is supplied to the loudspeaker unit 20 through the over-current protection element 53 without attenuation. Alternatively, if a large signal is impressed on the input terminals 10, a large current flows through the over-current protection element 53, the over-current protection element 53 generates heat, and presents a rapid increase in resistance. Consequently, the signal supplied to the loudspeaker unit 20 through the over-current protection element 53 is interrupted, the signal impressed on the input terminals 10 is thus supplied to the loudspeaker unit 20 through the resistor element 51 and the resistor element 52, thereby largely attenuating (attenuating by 6 dB) the signal supplied to the loudspeaker unit 20. As a result, damage to the loudspeaker unit 20 is prevented.

If the attenuation is to be set to −3 dB, the terminals 54*b* are short-circuited using the jumper wire JP. In this case, if the signal impressed on the input terminals 10 is at a normal level, the signal is supplied to the resistor element 52 through the over-current protection element 53, and is attenuated by the predetermined amount (3 dB) by the resistor element 52, and the resulting attenuated signal is supplied to the loudspeaker unit 20. Alternatively, if a large signal is impressed on the input terminals 10, the signal is interrupted by the rapid increase of the resistance of the over-current protection element 53, and the signal impressed on the input terminals 10 is thus supplied to the loudspeaker unit 20 through the resistor element 51 and the resistor element 52, thereby largely attenuating (attenuating by 6 dB) the signal supplied to the loudspeaker unit 20. As a result, damage to the loudspeaker unit 20 is prevented.

If the attenuation is to be set to −6 dB, the terminals 54*c* are short-circuited using the jumper wire JP. If the terminals 54*c* are short-circuited, this arrangement is the same as the case where only the serial circuit 50 (resistor elements 51, 52) is connected between the input terminal 10 and the loudspeaker 20. In this case, a signal impressed on the input terminals 10 is attenuated by the predetermined amount (6 dB) by the resistor elements 51 and 52, and then is supplied to the loudspeaker unit 20 whether the signal is at a normal level or a large signal. Even if a large signal is impressed on the input terminals 10, the signal is largely attenuated by the resistor element 51 and the resistor element 52, and thus, the loudspeaker unit 20 is not damaged. In addition, if the attenuation is set to −6 dB, since the signal impressed on the input terminals 10 is not supplied to the loudspeaker unit 20 through the over-current protection element 53, it is possible to eliminate degradation of the sound quality due to a characteristic of the over-current protection element 53 compared with the conventional case.

With the configuration described above, compared with the conventional case, it is possible to adjust the attenuation and simultaneously to provide the excessive input protection with a small number of resistor elements, thereby reducing the cost of the loudspeaker system. In addition, if there is set the maximum level of attenuation which eliminates the possibility of damage to the loudspeaker unit 20, it is possible to eliminate the degradation of the sound quality due to the characteristic of the over-current protection element 53.

It should be noted that although the above description for the first embodiment is given for the case where two resistor elements constitute the serial circuit 50, the number of resistor elements constituting the serial circuit 50 is not limited to this case, and the serial circuit may include a different number of resistor elements. If the number of resistor elements is increased, it is possible to adjust the attenuation more finely, of course.

Second Embodiment

Figure 2:
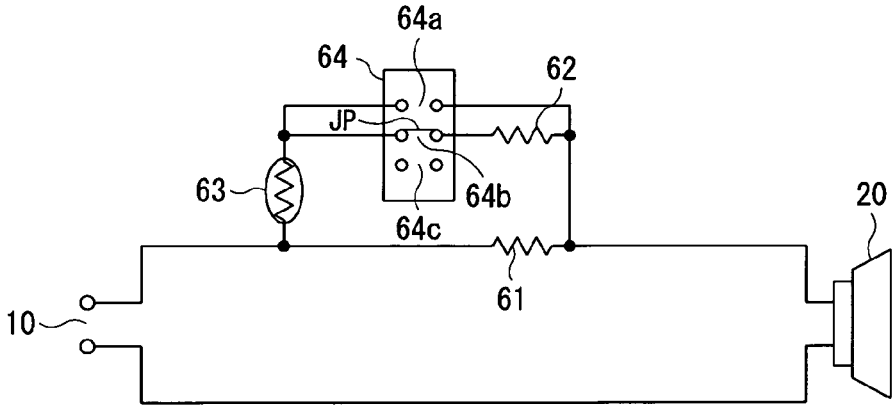
FIG. 2 shows the configuration of a loudspeaker system according to a second embodiment of the present invention.
Figure 3:
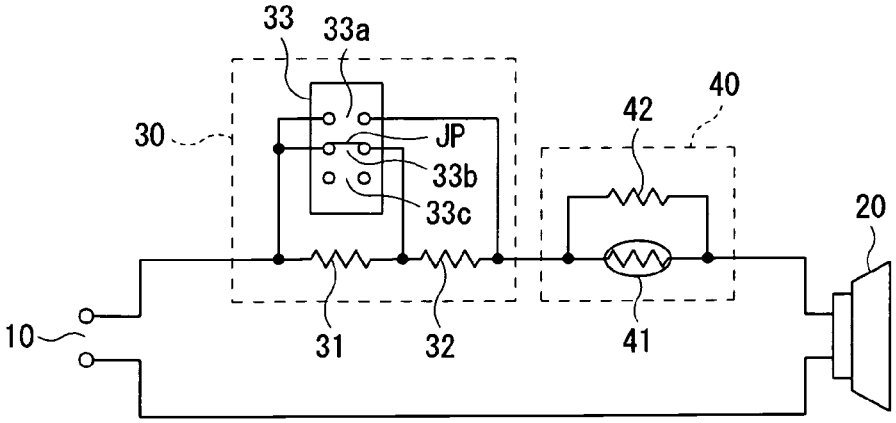
FIG. 3 PRIOR ART
FIG. 3 shows the configuration of a conventional loudspeaker system.

FIG. 2 shows the configuration of a loudspeaker system according to a second embodiment of the present invention. As FIG. 2 shows, the loudspeaker system according to the second embodiment includes input terminals 10, a loudspeaker unit 20, a first resistor element 61, a second resistor element 62, an over-current protection element 63, and a switch 64.

The first resistor element 61 is serially arranged between the input terminal 10 and the loudspeaker unit 20. The over-current protection element 63 is a resistor element having a positive temperature characteristic, for example; it generates heat if a current more than a predetermined magnitude is passed, which rapidly increases the resistance of the resistor element, and interrupts the signal current. The switch 64 is arranged so as to switch among a state connecting both ends of the first resistor element 61 through the over-current protection element 63, a connected state through the over-current protection element 63 and the second resistor element 62, and a disconnected state, thereby adjusting the attenuation according to a preference of a user by short-circuiting the terminals 64*a*, 64*b*, or 64*c* using a jumper wire JP.

According to the present embodiment, the resistances of the first resistor element 61 and the second resistor element 62 are set such that the attenuation is 0 dB, −3 dB, or −6 dB respectively if the terminals 64*a*, the terminals 64*b*, or the terminals 64*c* of the switch 64 are short-circuited. It should be noted that the resistance of the first resistor element 61 is set such that the maximum possible input signal impressed on the input terminals 10 does not cause an input signal to the loudspeaker unit 20 to exceed the maximum rated input of the loudspeaker unit 20.

The user short-circuits the terminals 64*a*, 64*b*, or 64*c* using the jumper wire JP on the switch 64 to attain the desired attenuation before using the loudspeaker system, thereby adjusting the attenuation.

If the attenuation is to be set to 0 dB, the terminals 64*a* are short-circuited using the jumper wire JP. In this case, if the signal impressed on the input terminals 10 is at a normal level, the signal is supplied to the loudspeaker unit 20 through the over-current protection element 64 without attenuation. Alternatively, if a large signal is impressed on the input terminals 10, a large current flows through the over-current protection element 63, the over-current protection element 63 generates heat, and presents a rapid increase in resistance. Consequently, the signal supplied to the loudspeaker unit 20 through the over-current protection element 63 is interrupted, the signal impressed on the input terminals 10 is thus supplied to the loudspeaker unit 20 through the first resistor element 61, thereby largely attenuating (attenuating by 6 dB) the signal supplied to the loudspeaker unit 20. As a result, damage to the loudspeaker unit 20 is prevented.

If the attenuation is to be set to −3 dB, the terminals 64*b* are short-circuited using the jumper wire JP. If the signal impressed on the input terminals 10 is at a normal level, the signal is supplied to the loudspeaker unit 20 through a parallel circuit including a serial circuit, which includes the over-current protection element 63 and the second resistor element 62, and the first resistor element 61. Namely, for a signal at a normal level, the signal is attenuated by the combined resistance of the first resistor element 61 and the second resistor element 62 by 3 dB, and then is supplied to the loudspeaker unit 20. Alternatively, if a large signal is impressed on the input terminals 10, the signal passing through the second resistor element 62 is interrupted by the rapid increase of the resistance of the over-current protection element 63, and the signal impressed on the input terminals 10 is thus supplied to the loudspeaker unit 20 only through the first resistor element 61, thereby largely attenuating (attenuating by 6 dB) the signal supplied to the loudspeaker unit 20. As a result, damage to the loudspeaker unit 20 is prevented.

If the attenuation is to be set to −6 dB, the terminals 64*c* are short-circuited using the jumper wire JP. If the terminals 64*c* are short-circuited, this arrangement is the same as the case where only the first resistor element 61 is connected between the input terminal 10 and the loudspeaker 20. In this case, a signal impressed on the input terminals 10 is attenuated by the predetermined amount (6 dB) by the first resistor element 61, and then is supplied to the loudspeaker unit 20 whether the signal is at a normal level or a large signal. Even if a large signal is impressed on the input terminals 10, the signal is largely attenuated by the first resistor element 61, and thus, the loudspeaker unit 20 is not damaged. In addition, if the attenuation is set to −6 dB, since the signal impressed on the input terminals 10 is not supplied to the loudspeaker unit 20 through the over-current protection element 63, it is possible to eliminate degradation of the sound quality due to a characteristic of the over-current protection element 63 compared with the conventional case.

With the configuration described above, compared with the conventional case, it is possible to adjust the attenuation and simultaneously to provide the excessive input protection with a small number of resistor elements, thereby reducing the cost of the loudspeaker system. In addition, if there is set the maximum level of attenuation which eliminates the possibility of damage to the loudspeaker unit 20, it is possible to eliminate the degradation of the sound quality due to the characteristic of the over-current protection element 63.

It should be noted that although the above description for the second embodiment is given for the case where one resistor element is selectively connected serially to the over-current protection element 63, the number of resistor elements is not limited to this case, and a different number of resistor elements may be used. If the number of resistor elements is increased, and the resistor elements are configured so as to be selected by the switch 64, it is possible to adjust the attenuation more finely.

Although the switches are described as switching the terminals to be short-circuited by means of the jumper wire JP in the first embodiment and the second embodiment, the switch is not limited to this case. The switch may be a switch which switches the terminals to be short-circuited by switching contacts by means of a slide operation or the like.

Further, although the descriptions are given for the cases where resistor elements having a positive temperature characteristic are used as the over-current protection element in the first embodiment and the second embodiment, the over-current protection element is not limited to this. The over-current protection element may be an element which simply interrupts the signal if a current more than a predetermined magnitude is impressed, and may be an element including a resistor element and a heat-sensitive switch such as a bimetal, for example.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A loudspeaker system comprising:

a serial circuit that includes a plurality of resistor elements connected serially with each other;

a loudspeaker unit connected to said serial circuit;

an over-current protection element that restricts an impressed signal current more than a predetermined signal current; and a switching circuit that selectively switches zero or more resistor elements of said serial circuit through said over-current protection element;

wherein said over-current protection element is not part of said serial circuit of resistor elements to which said loudspeaker unit is connected.

2. The loudspeaker system according to claim 1, wherein the combined resistance of all of the resistor elements included in said serial circuit is set such that the maximum possible input to the loudspeaker system does not cause an input to said loudspeaker unit to exceed the maximum input rating of said loudspeaker unit.

3. The loudspeaker system according to claim 2, wherein said over-current protection element is a resistor element having a positive temperature coefficient.

4. The loudspeaker system according to claim 2, wherein said over-current protection element comprises a resistor element and a heat-sensitive switch.

5. The loudspeaker system according to claim 1 wherein said over-current protection element is a resistor element having a positive temperature coefficient.

6. The loudspeaker system according to claim 1, wherein said over-current protection element comprises a resistor element and a heat-sensitive switch.

7. A loudspeaker system comprising:

a first resistor element;

at least one resistor element different from said first resistor element;

a loudspeaker unit connected to said first resistor element;

an over-current protection element that restricts an impressed signal current more than a predetermined signal current; and a switching circuit that switches among a state connecting said over-current protection element in parallel with said first resistor element, a state connecting said over-current protection element and said at least one resistor element in parallel with said first resistor element, and a disconnected state.

8. The loudspeaker system according to claim 7, wherein the resistance of said first resistor element is set such that the maximum possible input to the loudspeaker system does not cause an input to said loudspeaker unit to exceed the maximum input rating of said loudspeaker unit.

9. The loudspeaker system according to claim 8, wherein said over-current protection element is a resistor element having a positive temperature coefficient.

10. The loudspeaker system according to claim 8, wherein said over-current protection element comprises a resistor element and a heat-sensitive switch.

11. The loudspeaker system according to claim 7, wherein said over-current protection element is a resistor element having a positive temperature coefficient.

12. The loudspeaker system according to claim 7, wherein said over-current protection element comprises a resistor element and a heat-sensitive switch.

13. A loudspeaker system comprising:

a first resistance a loudspeaker unit connected to said first resistance in a serial circuit;

an over-current protection element that restricts an impressed signal current more than a predetermined signal current; and a switching circuit;

wherein said over-current protection element is connectable, through said switching circuit, in parallel with at least a portion of said first resistance, and said over-current protection element is not part of said serial circuit.

14. The loudspeaker system according to claim 13, wherein said switching circuit is selectively operable to set one of a plurality of resistances in a signal path to said loudspeaker unit through said over-current protection element.

15. The loudspeaker system according to claim 14, wherein said over-current protection element is one of a resistor element having a positive temperature coefficient and a resistor element in combination with a heat-sensitive switch.

16. The loudspeaker system according to claim 13, wherein the first resistance is set such that the maximum possible input to the loudspeaker system does not cause an input to said loudspeaker unit to exceed the maximum input rating of said loudspeaker unit.

17. The loudspeaker system according to claim 16, wherein said over-current protection element is one of a resistor element having a positive temperature coefficient and a resistor element in combination with a heat-sensitive switch.

* * * * *

UNITED STATES PATENT AND TRADEMARK OFFICE

CERTIFICATE OF CORRECTION

PATENT NO. : 7,630,505 B2
APPLICATION NO. : 11/016320
DATED : December 8, 2009
INVENTOR(S) : Naoki Shimamura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1390 days.

Signed and Sealed this

Second Day of November, 2010

David J. Kappos

David J. Kappos
*Director of the United States Patent and Trademark Office*